US010513009B2

(12) United States Patent
Janitschek

(10) Patent No.: US 10,513,009 B2
(45) Date of Patent: Dec. 24, 2019

(54) NOZZLE FOR FINE-KERF CUTTING IN AN ABRASIVE JET CUTTING SYSTEM

(71) Applicant: INFLOTEK B.V., Belfeld (NL)

(72) Inventor: Paulus Antonius Jacobus Janitschek, Meerhout (DE)

(73) Assignee: INFLOTEK B.V., Belfeld (NL)

( * ) Notice: Subject to any disclaimer, the term of this patent is extended or adjusted under 35 U.S.C. 154(b) by 393 days.

(21) Appl. No.: 14/431,143

(22) PCT Filed: Oct. 15, 2013

(86) PCT No.: PCT/NL2013/050732
§ 371 (c)(1),
(2) Date: Mar. 25, 2015

(87) PCT Pub. No.: WO2014/062057
PCT Pub. Date: Apr. 24, 2014

(65) Prior Publication Data

US 2015/0321316 A1 Nov. 12, 2015

Related U.S. Application Data

(60) Provisional application No. 61/713,758, filed on Oct. 15, 2012.

(51) Int. Cl.
*B24C 1/04* (2006.01)
*B24C 5/04* (2006.01)

(52) U.S. Cl.
CPC ..... *B24C 1/045* (2013.01); *B24C 5/04* (2013.01)

(58) Field of Classification Search
CPC ..... B24C 1/045; B24C 5/04; B24C 5/02
See application file for complete search history.

(56) References Cited

U.S. PATENT DOCUMENTS 5,794,858 A * 8/1998 Munoz ..... B05B 15/065 239/433
5,876,267 A * 3/1999 Kanda ..... B24C 5/04 451/102

(Continued)

FOREIGN PATENT DOCUMENTS

WO 2011/070154 A1 6/2011

OTHER PUBLICATIONS

International Search Report, dated Dec. 13, 2013, issued in priority International Application No. PCT/NL2013/050732.

*Primary Examiner* — Timothy V Eley
(74) *Attorney, Agent, or Firm* — Fisherbroyles, LLP

(57) ABSTRACT

The present invention provides a nozzle for high-pressure abrasive jet cutting systems that is particularly well-suited for fine-kerf cutting (e.g., 0.050 to 0.45 mm) using very fine abrasive particles (e.g., average particle size less than about 250 microns). The nozzle has a nozzle body defining an elongated channel extending along an axis. The elongated channel has a mixing stage and a focusing stage. The focusing stage has a focusing portion terminating in an outlet orifice for producing a high-pressure jet. The mixing stage has a sidewall defining a port in fluid communication with the elongated channel for admitting a low-pressure flow of a slurry comprising abrasive particles suspended in a fluid. The sidewall of the mixing stage is configured to have a relieved portion extending radially inwardly from the port toward the focusing stage. In certain embodiments, the taper is continuous from the port to the focusing stage.

33 Claims, 5 Drawing Sheets

(56) References Cited

U.S. PATENT DOCUMENTS

| | | | | |
|---|---|---|---|---|
| 6,012,653 | A * | 1/2000 | Gunther | B24C 1/045 239/432 |
| 6,837,775 | B2 * | 1/2005 | Anand | B24C 5/04 451/102 |
| 7,547,292 | B2 * | 6/2009 | Sheldrake | A61M 5/3015 604/68 |
| 9,156,133 | B2 * | 10/2015 | Miller | B24C 1/045 |
| 2002/0151250 | A1 * | 10/2002 | Ulrich | B24C 5/04 451/2 |

* cited by examiner

NOZZLE FOR FINE-KERF CUTTING IN AN ABRASIVE JET CUTTING SYSTEM

CROSS-REFERENCE TO RELATED APPLICATIONS

This application is a national stage application of international Application No. PCT/NL2013/050732, filed on Oct. 15, 2013, which is based on and claims the benefit of U.S. Provisional Application No. 61/713,758, filed Oct. 15, 2012, the entire contents of each of which are hereby incorporated fully herein by reference.

FIELD OF THE INVENTION

The present invention relates generally to abrasive jet cutting systems that use high-pressure jets of abrasive-carrying liquid to cut a work-piece, and more particularly to a nozzle and cutting head suitable for use in such systems that has improved structure permitting fine-kerf cutting.

DISCUSSION OF RELATED ART

Cutting systems using high-pressure jets of liquid are well-known in the art. Various such arrangements are known in the art, and are often referred to as "waterjet" systems. Some such systems use liquid-only jets, and are often referred to as "water-only jet," or "WJ" systems. Others involve use of jets of abrasive-carrying liquids. Some such systems involve use of a dry abrasive, and are often referred to as "abrasive waterjet," or "AWJ" systems. Other such systems involve use of an abrasive slurry or suspension, and are often referred to as an "abrasive slurry jet" or "abrasive suspension jet", or "ASJ".

FIG. 1 shows an exemplary cutting head 10 for use in an exemplary prior art AWJ system. In an exemplary cutting head 10, high-pressure liquid flows from an inlet 12 through a small orifice (typically about 0.1 to 0.7 mm in diameter) defined by a crystal 14, typically made of sapphire or diamond. A fine jet exiting the crystal 14 enters a mixing chamber 16. Small particles of garnet or other abrasive material are supplied to the mixing chamber 16 through an inlet 18.

The jet then flows through an elongated focusing tube 20 in a nozzle body 22, which often serves to accelerate the jet and entrained particles in the direction of liquid flow. The focused water jet then exits through an outlet 24 of the focusing tube 20. The jet, including the entrained abrasive particles, can then be used to cut a work-piece 5 of metal or other material.

In certain embodiments, the abrasive particles are relatively coarse, having an average particle size in the range of 0.075 mm to 0.350 mm. In such embodiments, the abrasive particles are often gravity-fed into the mixing chamber 16 in a stream of air/gas, which acts as a transport medium. By way of example, such embodiments are suitable to achieve a kerf size in the range of about 0.45 mm to 2.5 mm.

Energy losses in the cutting head 10 between the crystal 14 and the outlet 24 can be undesirably high. In part, kinetic energy of the water is lost by the need to accelerate the abrasive material. Further, significant frictional losses occur in the mixing chamber 16 and focusing tube 20, as abrasive particles impinge upon the walls, particularly during mixing.

The kerf width of a cut is proportional to the diameter of the jet stream in which the abrasive is carried. It is often desirable to create a relatively small kerf cut, and there is a lower limit to the kerf size achievable in the system described above, as the kerf size is depended largely upon the jet and abrasive particle size, and there is a particle size limit below which abrasive particles start forming clumps and therefore do not satisfactorily flow by gravity feed and/or in a flow of air. Conventional commercially-viable AWJ systems are typically limited to a minimum kerf size above about 0.45 mm. Downsizing of AWJ nozzles for creating a kerf less than 0.45 mm has been problematic.

To obtain a smaller kerf, ASJ systems involve use of a liquid as the transport medium for finer/smaller abrasive particles in the form of a pre-mixed slurry. Such systems are similar to the AWJ system described above with reference to FIG. 1, but generally involve supplying a high-pressure slurry in which abrasive particles are suspended from an inlet 12 through a small orifice defined by a crystal, typically made of sapphire or diamond, as shown in FIG. 2. A fine jet exiting the crystal is used for cutting purposes. No mixing chamber is required, as the abrasive particles are entrained in the slurry supplied to the crystal. For example, conventional ASJ systems are known to work well for particle sizes in the range of about 0.008 mm to about 0.080 mm, to provide a kerf size of approximately 0.01 mm to 0.2 mm in width.

Such slurry-based systems avoid a certain measure of the energy losses discussed above but nevertheless suffer from very rapid wear as a result of cutting action of the entrained abrasive particles. This makes ASJ systems commercially unfeasible, particularly for the long runs in thick materials that are demanded in many commercial manufacturing applications.

Further, as jet size is decreased to create a finer kerf, higher jet pressure and velocity are required for similar cutting action, which results in increased wear and decreased service lives of the nozzle and/or focusing tube. By way of example, exemplary AWJ nozzles may have a service life on the order of about 50-about 100 hours, whereas exemplary ASJ nozzles may have a service life on the of less than 1 hour.

Accordingly, these approaches results in undesirably large width of kerf, undesirable wear of the nozzle and/or result in inconsistent cutting.

What is needed is a cutting head, nozzle and high-pressure abrasive jet cutting system that is suitable for fine kerf cutting over extended periods of time.

SUMMARY

The present invention provides a novel cutting head, nozzle and high-pressure abrasive jet cutting system that provides for fine kerf cutting. Further the cutting head, nozzle and cutting system are particularly well-suited for fine-kerf cutting (e.g., from about 0.050 to about 0.45 mm) using very fine abrasive particles having an average particle size of less than approximately 250 microns, and more particularly, from about 15 to 225 microns, and optionally, less than approximately 150 microns.

The system and cutting head include the nozzle. The nozzle has a nozzle body defining an elongated channel extending along an axis. The elongated channel has a mixing stage and a focusing stage. The focusing stage has a focusing portion terminating in an outlet orifice for producing a high-pressure jet. The mixing stage has a sidewall defining a port in fluid communication with the elongated channel for admitting a low-pressure flow of a slurry comprising abrasive particles suspended in a fluid. The sidewall of the mixing stage is configured to have a relieved portion extending radially inwardly from the port toward the focusing stage. In certain embodiments, the taper is continuous from the port to the focusing stage.

BRIEF DESCRIPTION OF THE FIGURES

An understanding of the following description will be facilitated by reference to the attached drawings, in which.

DETAILED DESCRIPTION

The present invention relates to a cutting head and cutting system including a specially-configured nozzle that has a novel internal geometry that is configured to provide for fine kerf cutting. Perspective and cross-sectional views of an exemplary cutting head 50 are shown in FIGS. 3 and 4.

Figure 3:
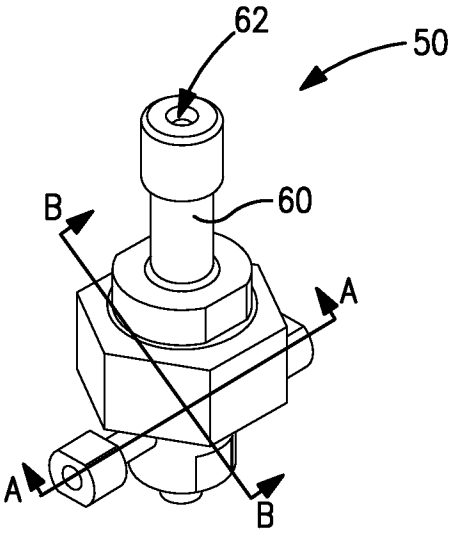
FIG. 3 is a perspective view of an exemplary cutting head in accordance with an exemplary embodiment of the present invention.
Figure 5:
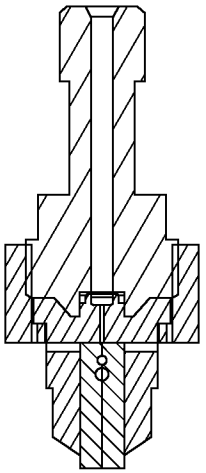
FIG. 5 is a cross-sectional view of the cutting head of FIG. 3, taken alone line BB of FIG. 3.
Figure 4:
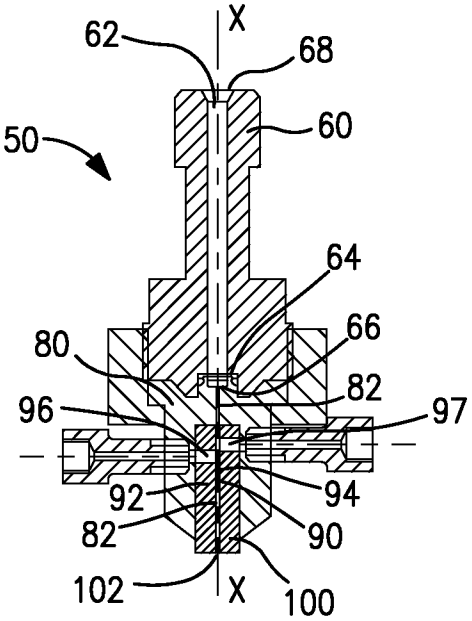
FIG. 4 is a cross-sectional view of the cutting head of FIG. 3, taken alone line AA of FIG. 3.

Referring now to FIGS. 3 and 4, the exemplary cutting head 50 may be generally consistent with prior art cutting heads in that the cutting head 50 includes an inlet stage 60 defining a liquid supply conduit 62 for receiving pressurized liquid from a pump (not shown). As known in the art, a jet is generated by pumping high-pressure liquid through an orifice to achieve supersonic speeds based on Bernoulli's principle. Typically, the pressurized liquid is supplied at a pressure of approximately 1000 to 6000 bar, and more often in the range of about 3500 to 4500 bar, as will be appreciated by those skilled in the art. As will be appreciated by those skilled in the art, the liquid may be water or a mixture of water and additives provided to minimize dispersion of the jet as it exits the nozzle. The conduit 62 terminates at a die 64 defining an inlet orifice 66. The inlet orifice 66 is dimensioned to have a smaller cross-sectional area than the conduit, and thus creates a fine, high-velocity jet of liquid. By way of example, the inlet orifice 66 may have an internal diameter in the range of about 0.08 to about 0.6 mm, and may be constructed of diamond or sapphire material. Downstream from the die 64 is a mixing chamber 92. In the example shown, the mixing chamber 92 is defined in a nozzle housing 80 mated with the inlet stage 60 by means of a threaded coupling 70. The mixing chamber 92 has a larger cross-sectional area than the inlet orifice 66 of the die 64. Downstream from the mixing chamber 92 is a focusing stage 100 that terminates in a jet-defining outlet orifice 102 for producing a high-pressure abrasive jet. The focusing stage 100 serves to collimate the water forming the jet. The focusing stage 100 is preferably a constant-diameter portion of the nozzle immediately adjacent the outlet orifice 102, which serves as the outlet of the cutting head 50. The length of the focusing stage may be selected to increase exit beam coherency and/or to increase the overall service life of the mixing tube. The outlet orifice 102 may have any suitable size, which will depend in large part upon the size distribution of abrasive particles to be used. For example, the jet-defining orifice 102 may have a diameter in the range of about 0.08 to about 0.6 mm. As known in the prior art, the nozzle housing 80 may include a nozzle 90 constructed of a material dissimilar to that of a remainder of the nozzle housing 80, and press-fit or mechanical secured into a corresponding opening in the body. For example, tungsten carbide may be selected as the material for the nozzle 90 to provide for increased durability and service life.

In accordance with a preferred embodiment of the present invention, the cutting head 50 is configured for very-fine kerf cutting, e.g., to provide a kerf less than 0.5 mm in width, e.g., from about 0.050 mm to about 0.45 mm in width. In such an embodiment, inlet liquid pressure in the range of about 3000 to about 4000 bar may be suitable. In such an embodiment, the inlet orifice 66 may have an area/diameter in the range of about 0.08 to about 0.45 mm, and the jet-defining outlet orifice 102 may have an area/diameter of about 0.08 mm to about 0.6 mm.

In contrast to the prior art and in accordance with the present invention, the nozzle 90 has a novel internal geometry configured to provide a very-fine cutting beam, and thus a very-fine kerf cut. The novel internal geometry relates most specifically to the structure of a mixing stage of the nozzle 90/nozzle housing 80, namely, that portion of the nozzle 90 in which the particles of the abrasive slurry flow are accelerated by and combined with the high-pressure liquid jet, prior to any focusing stage 100. In particular, a mixing chamber 92 is provided with a relieved sidewall portion extending radially outwardly from the focusing stage, outside of a path of a jet traveling from the conduit 62 to the outlet orifice 102. Thus, the sidewall is tapered inwardly from the upstream end toward the outlet orifice 102. This relieved sidewall creates a clearance space between the slurry inlet and the jet path and effectively increases the surface area of the slurry exposed for entrainment into the liquid jet.

Further, a slurry port is provided at a single circumferential location immediately adjacent the relieved sidewall portion. The use of fine abrasive particles in a slurry, the relieved sidewall, reduced overall clearance between jet and the mixing chamber sidewalls, and/or the gradual introduction of the abrasive slurry adjacent and/or along the relieved sidewall allows for a controlled entrainment of the abrasive into the cutting beam, permitting rapid abrasive particle acceleration over a short distance, and thus an overall shorter nozzle length, as discussed in greater detail below. A shorter overall nozzle length is advantageous because there is less energy loss in the waterjet beam due to friction between the waterjet beam and the tube. Furthermore, a very short nozzle can provide an exit beam that is more dispersed and therefore generates a tapered cut in the target material to be cut. This can be advantageous in the production of certain industrial screens where self-relieving slots are an important requirement.

A mixing chamber 92 having a width 1.5-2 times larger than a diameter of the inlet orifice 66 has been found suitable. For example, for an inlet orifice measuring 0.1 mm in diameter, a mixing chamber measuring 0.15 to 0.2 mm in nominal width (not including the relieved portion) has been found suitable. Such an arrangement provides minimal clearance between the beam as it passes through the mixing chamber, and the sidewalls of the mixing chamber. Such minimal clearance is believed to reduce opportunities for abrasive particle impingement upon the sidewalls, and particle clumping, and rather to promote entrainment of the particles in the passing beam.

Referring now to FIGS. 3-7, the nozzle housing 80 defines an elongated channel 82 in fluid communication with the inlet orifice 66 and thus the inlet conduit 62. The elongated channel 82 extends along an axis X central to the inlet orifice 66 to the outlet orifice 102, as best shown in FIG. 3. The elongated channel 82 spans a mixing chamber 92 and a focusing stage 100. In certain embodiments, the focusing stage's length is about 10% to about 50% of the length of the nozzle 90, and the mixing chamber 92 is about 1% to about 80% of the length of the nozzle 90. Focusing stage length may be varied to balance tradeoffs between increased beam cohesion and nozzle life with loss of efficiency and cutting speed considerations.

Figure 7:
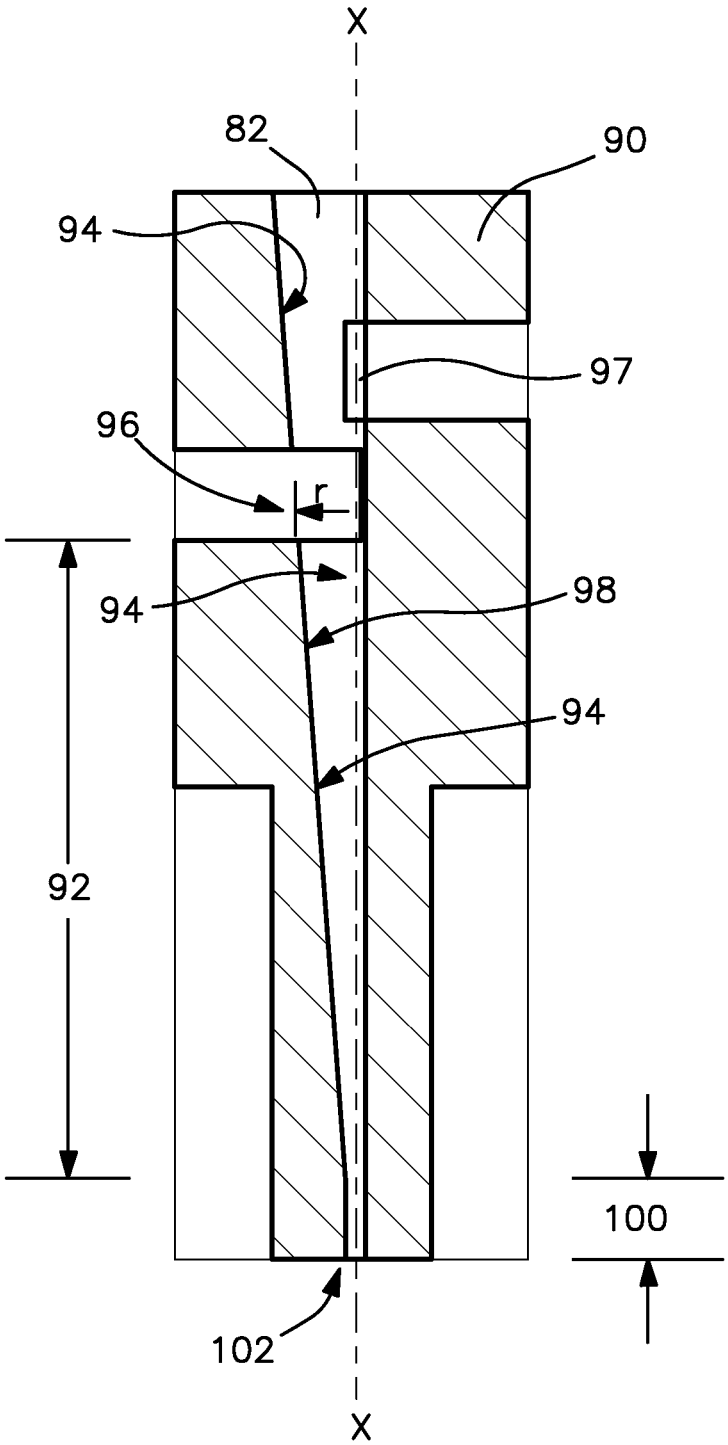
FIG. 7 is an enlarged view of the nozzle of the cutting head of FIG. 3.

As best shown in FIGS. 4 and 7, the mixing chamber 92 is defined by a sidewall 94 of the nozzle housing 80. The nozzle housing 80 further defines at least one port 96 in fluid communication with the elongated channel 82 for admitting into the mixing chamber 92 a low-pressure flow of slurry. For example, the slurry flow may be pressurized by a pressure system comprising a peristaltic pump configured to supply the slurry flow at a mass flow rate of approximately 8-20% of the mass of the water beam. The slurry flow comprises abrasive particles suspended in a fluid, such as water. By way of example, the abrasive particles may comprise garnet, sand, aluminum oxide, olivine or other materials commonly used in AWJ applications. By way of further example, such particles may have an average particle size in the range of about 0.005 mm to about 0.225 mm. In a preferred embodiment of the invention, the abrasive particles are selected to provide a very-fine kerf cut, and have an average particle size in the range of about 0.15 mm to about 0.225 mm.

In accordance with the present invention, the sidewall 94 of the mixing stage 92 has a relieved portion 98, as best shown in FIG. 7. The relieved portion 98 extends radially outwardly from axis X, in a region between the focusing stage 100 and the slurry inlet port 96. This relieved portion 98 is provided as a gradual taper beginning at the downstream edge of the slurry port 96. In certain embodiments, the taper continues to the focusing stage 100, as shown in FIG. 7. Thus, the relieved portion 98 of the sidewall creates a clearance space between the sidewall 94 of the mixing chamber 92 and the jet path extending along axis X, and tends to cause the slurry flow received via slurry port 96 to flow downwardly along the relieved sidewall 98, as shown schematically in FIG. 8. No portion of the relieved sidewall 98 is disposed so as to traverse the X axis or the jet's path, which would result in impingement of the jet on the sidewall. Rather, the relieved portion 98 creates a clearance space outside of the jet's path through the die orifice 66 to the outlet orifice 102, which orifices are concentrically aligned about axis X. This alignment substantially prevents impingement of the passing water jet against the nozzle body, and resulting wear and loss of energy. Thus, the relieved portion does not serve to redirect the liquid flow, or to accelerate or focus the liquid flow, but rather creates a clearance space for a slurry flow along the surface area of the relieved sidewall, outside of the jet path. The abrasive particle slurry from the slurry port 96 and/or flowing along the relieved sidewall is picked up and accelerated by the passing beam, along the sidewall or otherwise, to provide for rapid acceleration of the abrasive particles over a short distance. Further, supplying the slurry gradually tends to prevent clogging and excess impingement, and rather tends to promote particle entrainment in an orderly manner.

Figure 1:
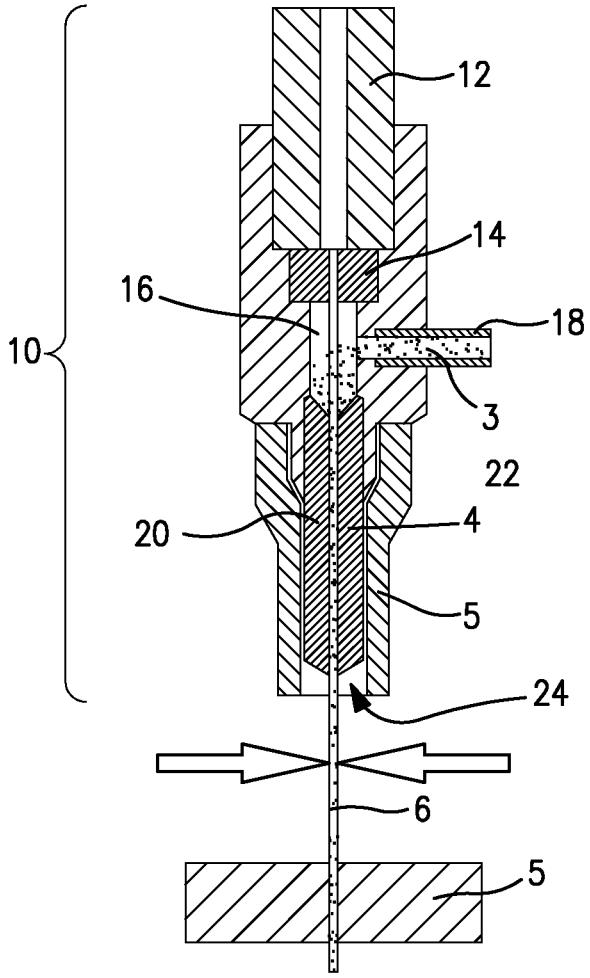
FIG. 1 PRIOR ART
FIG. 1 is a schematic cross-sectional view of an exemplary prior art cutting head for use in an abrasive waterjet (AWJ) cutting system.
Figure 2:
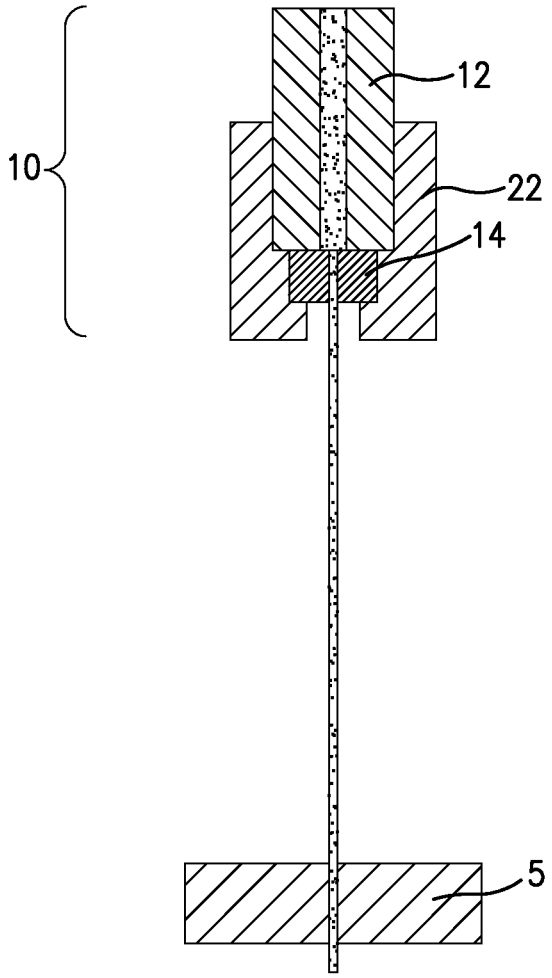
FIG. 2 PRIOR ART
FIG. 2 is a schematic cross-sectional view of an exemplary prior art cutting head for use in an abrasive slurry (ASJ) cutting system.
Figure 6:
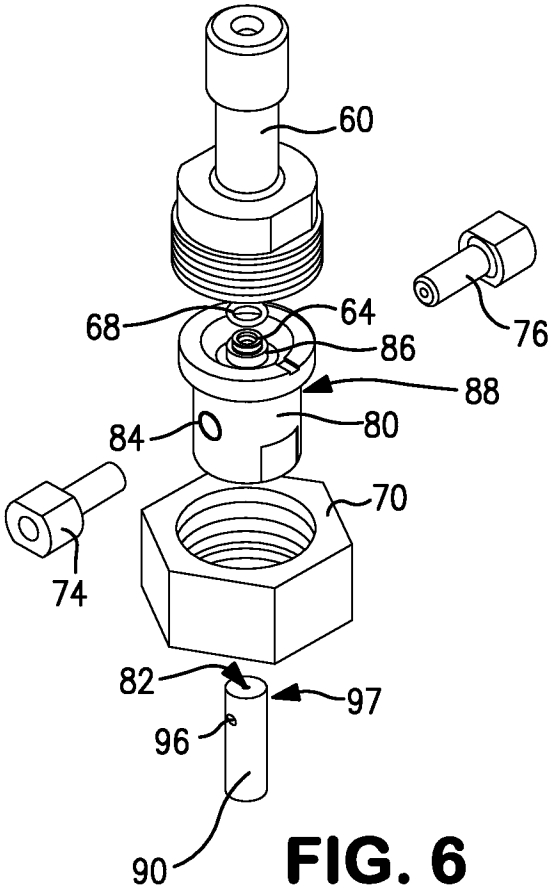
FIG. 6 is an exploded view of the cutting head of FIG. 3.

It should be noted that in certain embodiments, the channel 82 is asymmetrical in cross-section transverse to axis X (see nozzle 90, FIG. 6). In certain embodiments, the channel 82 is formed by providing a central through-bore dimensioned to provide the desired outlet orifice 102 dimension in a solid blank, and then further working the blank to provide a relieved sidewall 98 extending radially outwardly relative to the focusing stage 100. Accordingly, the sidewall may be further relieved/tapered above (upstream) from the slurry port 96 as a result of the further working of the blank, though this tapered portion of the sidewall 94 is not strictly required to achieve the results described herein.

For example, the outlet orifice 102 and the through-bore may be circular in cross-section and may have a diameter in the range of about 0.15 mm to about 0.45 mm. It should be noted that dimensions of the outlet orifice 102, the slurry port 96, the inlet orifice 66 and the central bore, and abrasive grain size must all be dimensioned in concert to prevent clogging by the abrasive particles. For example, an outlet orifice 102 or central bore having a diameter 2-3 times the abrasive particle size has been found suitable. The slurry port 96 should not be less than three times the abrasive particle size. Accordingly, for very-fine kerf cutting, die inlet orifices in the range of about 0.08 mm to about 0.6 mm, central bores in the range of about 0.15 to about 0.45 mm, and maximum particle size in the range of about 15 microns to about 225 microns have been found suitable.

Further, in accordance with the present invention, the cutting head length 50 from entry orifice 68 to jet-defining orifice 102 is relatively short, measuring about 20 mm to about 50 mm in length, as compared to approximately 70 mm to about 150 mm in length in conventional prior art cutting heads. The relatively shorter length provides relatively less opportunity for energy loss as the abrasive particles collide with one another or the cutting head components.

A relief angle defined between the relieved sidewall 98 and the axis X may vary in accordance with changes in particle size. The relief angle is defined by the length of the taper in a direction along axis X and the radial distance r in which the taper extends from the axis X at the downstream edge of the slurry port 96 (see FIG. 7). Generally, a suitable radial distance r is about 2.5-about 4 times the average particle size.

In this embodiment, the cutting head 50 is a multi-piece design that includes a nozzle housing 80 that is mechanically joined to the inlet stage 60 by a coupler 70 that has internal threads complementary to those of the external threads of the inlet stage 60, as best shown in FIG. 6. The nozzle housing 80 includes a nozzle 90 that is press-fit or mechanically secured into the nozzle housing, at least one duct 84 for receiving a slurry supply line 74 for supplying slurry to the nozzle via the nozzle's port 96. The nozzle housing 80 further defines a socket 86 for receiving the die 64, and a pressure seal 68 circumscribing the die 64 and socket 86.

Though optional, in this exemplary embodiment, the nozzle 90 defines a control port 97, and the nozzle housing 80 includes a second duct 88 for receiving a control medium supply line 76 for supplying a control medium to the nozzle via the nozzle's control port 97. By way of example, the control medium could be pressurized gas or liquid. By selectively supplying pressurized control medium to the nozzle 90 via the control port 97, the mixing chamber 92 is pressurized sufficiently to disrupt the flow of abrasive slurry into the nozzle 90. Accordingly, cutting action of the cutting head may be stopped (by stopping the flow of abrasive) without the need to stop the flow of high-pressure liquid. This arrangement is described in greater detail in PCT Patent Application Publication No. PCT/EP2011/051579, the entire disclosure of which is hereby incorporated herein by reference. This arrangement may be particularly advantageous in very-fine kerf cutting applications and/or for discontinuous cutting applications in which it is desirable to frequently start and stop the cutting action. In a preferred embodiment, control port 97 is provided upstream from slurry inlet port 96 to prevent clogging of the control port 97 with slurry flowing from the inlet port 96.

In use, water or other liquid is pressurized by a first pressure system, such as a constant pressure pump, to the required pressure (such as 3200 bar) and is supplied as a high-pressure liquid stream to the inlet stage 60 of the cutting head 50 of FIG. 3. The high-pressure liquid passes through the conduit 62 of the inlet stage 60, and through the inlet orifice 66 of the die 64. The small-diameter inlet orifice 66 creates a high-velocity (e.g., Mach 2) liquid jet that enters the elongated channel 82 of the nozzle housing 80.

Slurry is pressurized by a second pressure system, such as a peristaltic pump, at the required mass flow rate, and is supplied as a low-pressure slurry stream to the slurry port 96 of the nozzle 90 of the cutting head.

It should be noted that slurry and liquid flow rates should be selected to complement one another to provide satisfactory results. A slurry flow rate in the range of about 8% to about 20% of the water flow rate has been found appropriate for many applications. For example, for a water flow rate of 500 g/min, and a slurry flow rate of 50 g/min may be suitable.

Figure 8:
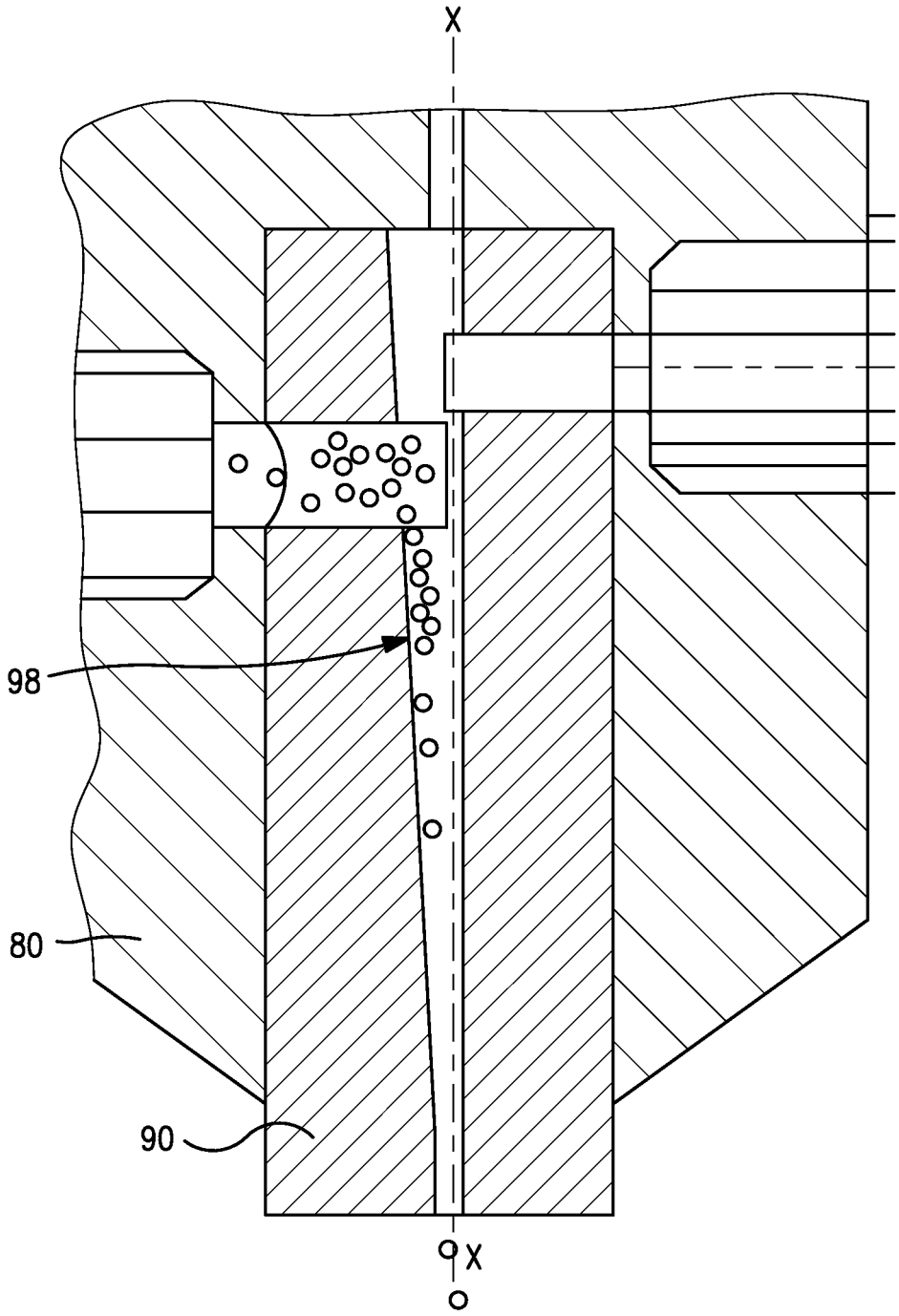
FIG. 8 is a schematic view of the nozzle of FIG. 7 in operation.

The slurry is introduced into the mixing chamber 92 through the inlet 96 at sufficiently low pressure and/or flow rate that it tends to flow downwardly along the relieved sidewall 98, as shown schematically in FIG. 8. The passing liquid jet creates a low pressure region in the mixing chamber 92 that draws the slurry/abrasive particles into the passing jet.

As the liquid and slurry travel along the elongated channel 82, the abrasive particles and slurry are accelerated and become well-mixed into the liquid jet. The abrasive-entrained liquid then passes through the focusing stage 100 and exits the outlet orifice 102 at high velocity, e.g., supersonic velocity in the range of Mach 1-Mach 3.

It will be appreciated that the slurry will flow into nozzle only when the pressure in the supply line 74 exceeds the pressure in the mixing chamber 92, which in some embodiments may be selectively increased or decrease to start and stop slurry flow by introduction of a pressurized control medium via control port 97. Accordingly, cutting can be started and stopped as described in PCT Patent Application Publication No. PCT/EP2011/051579, and the cutting head 50 may be manipulated to effect cutting in a largely conventional manner, e.g., as carried on a conventional two-dimensional cutting table It will be appreciated that the novel nozzle structure described herein is advantageous over a wide range of particle and kerf sizes. It should be noted however that the arrangement described herein is particularly advantageous for producing fine-kerf cuts of about 0.45 mm in width or less (and preferably from about 0.1 mm to about 0.4 mm in width), using an outlet orifice 102/bore and jet of less than about 0.45 mm, and preferably between about 0.1 mm and about 0.45 mm, with abrasive particle sizes in the range of about 5 microns to about 225 microns.

Advantageously, for a finer liquid jet and a relatively lower liquid flow rate, a relatively smaller pump is needed. For a given pump and flow rate, relatively more jets, and thus cutting heads, can be supported simultaneously. by way of example, a 75 kw pump with a 10 l/min flow rate has been found suitable for producing a 3500 bar high-pressure liquid stream capable of simultaneously supporting up to 36 cutting heads producing 0.1 mm abrasive liquid jets and up to 9 cutting heads producing 0.2 mm abrasive liquid jets. This compares favorably to a comparable prior art system, which would typically simultaneously support 4 cutting heads producing 0.08 mm to 0.45 mm abrasive liquid jets. The present invention thus permits use of a finer jet, which not only provides a finer kerf, but is also capable of providing relatively faster cutting using a larger number of cutting heads for a given pump size.

While there have been described herein the principles of the invention, it is to be understood by those skilled in the art that this description is made only by way of example and not as a limitation to the scope of the invention, and that various changes in detail may be effected therein without departing from the spirit and scope of the invention as defined by the claims.

The invention claimed is:

1. A nozzle for an abrasive jet cutting system, the nozzle comprising:

a nozzle body defining an elongated channel extending along an axis, said elongated channel extending along said axis having a portion defining a mixing chamber and a focusing stage, said focusing stage having a focusing portion terminating at an outlet orifice for producing a high-pressure jet, said mixing chamber having a sidewall defining a slurry port in fluid communication with said elongated channel for admitting a low-pressure flow of a slurry comprising abrasive particles suspended in a fluid into said mixing chamber, said sidewall of said mixing chamber comprising a relieved portion extending radially inwardly from said slurry port toward said focusing stage to cause said abrasive particles to mix with and become entrained in said high-pressure jet within said mixing chamber, wherein said sidewall of the relieved portion of said

EXEMPLARY EMBODIMENTS

| Parameter | Example 1 | Example 2 | Example 3 | Example 4 |
|---|---|---|---|---|
| inlet orifice diameter 66 | 0.1 mm | 0.12 mm | 0.15 mm | 0.3 mm |
| outlet bore diameter 102 | 0.15 mm | 0.18 mm | 0.22 mm | 0.45 mm |
| slurry inlet diameter 96 | 0.3 mm to 1.5 mm | 0.3 mm to 1.5 mm | 0.3 mm to 1.5 mm | 0.3 mm to 1.5 mm |
| avg particle size | 15-100 micron | 50-100 micron | 100-150 micron | 175-225 micron |
| r | >200 microns | >320 microns | >470 microns | >850 microns |
| nozzle 90 length | 2-3 cm | 2-3 cm | 2-3 cm | 2-3 cm |
| focusing tube 100 length | 4 mm | 4 mm | 4 mm | 4 mm |
| mixing chamber 92 length | 12 mm | 12 mm | 12 mm | 12 mm |
| jet size | 0.15 mm | 0.18 mm | 0.22 mm | 0.45 mm |
| kerf width | 80-120 microns | 100-150 microns | 180-250 microns | 350-450 microns |

mixing chamber causes said elongated channel to be asymmetrical in cross-section transverse to the axis within the portion of said mixing chamber where said abrasive particles will become entrained in said high-pressure jet, and wherein said relieved portion's sidewall extends in tapered fashion from said slurry port toward said focusing stage, said asymmetrical cross-section of said elongated channel and said tapered sidewall collectively providing clearance, for the flow of slurry, between said sidewall and the axis that progressively decreases with increased proximity to the focusing stage.

2. The nozzle of claim 1, wherein said relieved portion is tapered inwardly in a direction extending along the axis between said slurry port and said focusing stage.

3. The nozzle of claim 1, wherein the relieved portion is tapered inwardly in a direction extending along the axis from said slurry port to said focusing stage.

4. The nozzle of claim 3, wherein the relieved portion is tapered inwardly from said slurry port to said focusing stage.

5. The nozzle of claim 1, wherein said focusing stage has a consistent cross-sectional diameter.

6. The nozzle of claim 1, wherein said nozzle has a first length, and wherein said mixing chamber has a length of about 1% to about 80% of the first length.

7. The nozzle of claim 1, wherein said nozzle has a first length, and wherein said relieved portion extends along said axis for a second length of about 1% to about 80% of the first length.

8. The nozzle of claim 1, wherein said relieved portion extends radially outwardly from the axis, in a region between said focusing stage and said slurry port, by a radial distance r that varies with axial position along the axis.

9. The nozzle of claim 8, wherein r is greater than approximately 45 microns and less than approximately 900 microns.

10. The nozzle of claim 1, wherein said outlet orifice is circular in cross-section and has a diameter in the range of about 0.15 mm to about 0.45 mm.

11. A cutting head for an abrasive jet cutting system for cutting with abrasive particles having a maximum size in the range of about 15 microns to about 225 microns, said cutting head comprising:

an inlet stage defining a conduit to an inlet orifice for defining a liquid jet; and a nozzle comprising:

a nozzle body defining an elongated channel extending along an axis central to said inlet orifice for admitting passage of the liquid jet, said elongated channel defining a mixing chamber and a focusing stage, said focusing stage having a focusing portion terminating at an outlet orifice for producing a high-pressure jet, said mixing chamber having a sidewall defining a port in fluid communication with said elongated channel for admitting a low-pressure flow of a slurry comprising abrasive particles suspended in a fluid into said mixing chamber, said nozzle body defining said focusing stage in axial alignment with said inlet orifice along said axis, said sidewall of said mixing chamber comprising a relieved portion extending radially inwardly from said slurry port toward said focusing stage to cause said abrasive particles to mix with and become entrained in said high-pressure jet within said mixing chamber, wherein said sidewall of the relieved portion of said mixing chamber causes said elongated channel to be asymmetrical in cross-section in a direction transverse to the axis within the portion of said mixing chamber where said abrasive particles will become entrained in said high-pressure jet, and wherein said relieved portion's sidewall extends in tapered fashion from said slurry port to said focusing stage, said asymmetrical cross-section of said elongated channel and said tapered sidewall collectively providing clearance, for the flow of slurry, between said sidewall and the axis that progressively decreases with increased proximity to the focusing stage;

wherein said inlet stage defines an entry orifice that is circular in cross-section and has a diameter in the range of about 0.08 mm to about 0.6 mm;

wherein said cutting head has a length from said entry orifice to said outlet orifice of about 20 mm to about 50 mm;

wherein said relieved portion extends radially outwardly from the axis, in a region between said focusing stage and said slurry port, by a radial distance r that varies with axial position along the axis, wherein r is greater than approximately 45 microns and less than approximately 900 microns, and is about 2.5 to about 4 times an average particle size; and wherein said outlet orifice is circular in cross-section and has a diameter in the range of about 0.15 mm to about 0.45 mm.

12. The cutting head of claim 11, wherein said mixing chamber has a width about 1.5 to about 2.0 times larger than a diameter of said inlet orifice.

13. The cutting head of claim 11, wherein said nozzle is mechanically joined to said inlet stage.

14. The cutting head of claim 11, wherein said relieved portion is tapered inwardly in a direction extending along the axis between said slurry port and said focusing stage.

15. The cutting head of claim 11, wherein said relieved portion is tapered inwardly in a direction extending along the axis from said slurry port toward said focusing stage.

16. The cutting head of claim 15, wherein said relieved portion is tapered inwardly from said slurry port to said focusing stage.

17. The cutting head of claim 11, wherein said focusing stage has a consistent cross-sectional diameter.

18. The cutting head of claim 11, wherein said nozzle has a first length, and wherein said mixing chamber has a length of about 1% to about 80% of the first length.

19. The cutting head of claim 11, wherein said nozzle has a first length, and wherein said relieved portion extends along said axis for a second length of about 1% to about 80% of the first length.

20. The cutting head of claim 11, wherein said channel is asymmetrical in cross-section transverse to the axis.

21. An abrasive jet cutting system comprising:

a cutting head comprising:

an inlet stage defining a conduit to an inlet orifice for defining a liquid jet; and a nozzle comprising:

a nozzle body defining an elongated channel extending along an axis central to said inlet orifice for admitting passage of the liquid jet, said elongated channel defining a mixing chamber and a focusing stage, said focusing stage having a focusing portion terminating at an outlet orifice for producing a high-pressure jet, said mixing chamber having a sidewall defining a slurry port in fluid communication with said elongated channel for admitting a low-pressure slurry flow into said mixing chamber, said sidewall of said mixing chamber comprising a relieved portion extending radially inwardly from said slurry port toward said focusing stage stage to cause said abrasive particles to mix with and become entrained in said high-pressure jet within said mixing chamber, wherein said sidewall of the relieved portion of said mixing chamber causes said elongated channel to be asymmetrical in cross-section in a direction transverse to the axis within the portion of said mixing chamber where said abrasive particles will become entrained in said high-pressure jet, and wherein said relieved portion's sidewall extends in tapered fashion from said slurry port to said focusing stage, said asymmetrical cross-section of said elongated channel and said tapered sidewall collectively providing clearance, for the flow of slurry, between said sidewall and the axis that progressively decreases with increased proximity to the focusing stage;

a first pressure system configured to supply a high-pressure liquid stream to said cutting head;

a second pressure system configured to supply the slurry flow via said slurry port, said slurry flow comprising a flow of a slurry comprising abrasive particles suspended in a fluid, said abrasive particles having a maximum size in the range of about 5 microns to about 225 microns;

wherein said inlet stage defines an entry orifice that is circular in cross-section and has a diameter in the range of about 0.08 mm to about 0.6 mm;

wherein said cutting head has a length from said entry orifice to said outlet orifice of about 20 mm to about 50 mm;

wherein said relieved portion extends radially outwardly from the axis, in a region between said focusing stage and said slurry port, by a radial distance r that varies with axial position along the axis, wherein r is greater than approximately 45 microns and less than approximately 900 microns, and is about 2.5 to about 4 times an average particle size; and wherein said outlet orifice is circular in cross-section and has a diameter in the range of about 0.15 mm to about 0.45 mm.

22. The abrasive jet cutting system of claim 21, wherein said first pressure system is configured to supply the high-pressure liquid stream at a first mass flow rate, and wherein said second pressure system is configured to supply the slurry flow at a second mass flow rate of approximately 8%-20% of the first mass flow rate.

23. The abrasive jet cutting system of claim 21, wherein said outlet orifice has a diameter in the range of about 2 to about 3 times the average abrasive particle size.

24. The abrasive jet cutting system of claim 21, wherein said slurry port has a cross-sectional area greater than three times the average abrasive particle size.

25. The abrasive jet cutting system of claim 21, wherein said mixing chamber has a width from about 1.5 to about 2.0 times larger than a diameter of said inlet orifice.

26. The abrasive jet cutting system of claim 21, wherein said nozzle is mechanically joined to said inlet stage.

27. The abrasive jet cutting system of claim 21, wherein said relieved portion is tapered inwardly in a direction extending along the axis between said slurry port and said focusing stage.

28. The abrasive jet cutting system of claim 21, wherein said relieved portion is tapered inwardly in a direction extending along the axis from said slurry port toward said focusing stage.

29. The abrasive jet cutting system of claim 28, wherein said relieved portion is tapered inwardly from said slurry port to said focusing stage.

30. The abrasive jet cutting system of claim 21, wherein said focusing stage has a consistent cross-sectional diameter.

31. The abrasive jet cutting system of claim 21, wherein said nozzle has a first length, and wherein said mixing chamber has a length of about 1% to about 80% of the first length.

32. The abrasive jet cutting system of claim 21, wherein said nozzle has a first length, and wherein said relieved portion extends along said axis for a second length of about 1% to about 80% of the first length.

33. The abrasive jet cutting system of claim 21, wherein said channel is asymmetrical in cross-section transverse to the axis.

* * * * *